United States Patent [19]

Harwood

[11] Patent Number: 4,980,664

[45] Date of Patent: Dec. 25, 1990

[54] TRANSFORMER BOBBIN

[75] Inventor: John R. Harwood, McHenry, Ill.

[73] Assignee: Prem Magnetics Incorporated, McHenry, Ill.

[21] Appl. No.: 490,474

[22] Filed: Mar. 8, 1990

[51] Int. Cl.[5] ..... H01F 15/10; H01F 27/30

[52] U.S. Cl. ..... 336/192; 242/118.41; 336/198

[58] Field of Search ..... 336/90, 98, 192, 198, 336/208; 242/118.41; 310/194

[56] References Cited

U.S. PATENT DOCUMENTS 3,750,072 7/1973 Weiner ..... 336/208 X 4,405,913 9/1983 Finkbeiner ..... 336/198 X 4,716,394 12/1987 Gordon ..... 336/198 X

*Primary Examiner*—Thomas J. Kozma

*Attorney, Agent, or Firm*—Sherman and Shalloway

[57] ABSTRACT

A transformer bobbin assembly comprises a bobbin and a shroud. The bobbin includes an intermediate wall having a key block formed on one side thereof. The shroud includes at least one wall slidable over the intermediate wall of the bobbin, on the side having the key block formed thereon, whereby the shroud wall, the key block and the intermediate wall of the bobbin cooperate to provide predetermined minimum creepage and clearance distances between the coils wound on the bobbin.

2 Claims, 4 Drawing Sheets

TRANSFORMER BOBBIN

BACKGROUND OF THE INVENTION

1. Field of the Invention

The present invention is directed to transformer bobbin bodies. More particularly, the present invention is directed to a molded transformer bobbin assembly.

2. Description of the Prior Art

Transformer bobbin bodies are normally formed of plastics materials. Two primary types are used, those having axially separated winding areas and those having radially separated winding areas. Such bobbin bodies may have primary and secondary winding areas, two primary and a single secondary, or two secondary and a single primary. The primary area and secondary area are normally separated by a wall member. A common design is to provide a core tube, normally rectangular in cross-section, and a plurality of outwardly projecting flange walls axially spaced along the length of the core tube to define winding areas between the walls radially of the core tube. Such transformer bobbins are formed, as desired, with other projecting members such as mounting members, pin members, etc. Commonly, the entire transformer bobbin is formed of a single molded plastic piece. Existing winding machines are designed to accommodate such single piece coil bodies.

Some countries, such as the countries of the European common market, have adopted standards providing for a minimum creepage distance between the primary and secondary windings. Although such minimum creepage distances can be established by making the projecting walls between the winding areas of a height from the outermost coil winding equal to at least half the minimum creepage distance, whereby the entire minimum creepage distance will be established as the path up one side of the wall from the winding of the one coil thence down the other side of the wall to the winding of the other coil, such a solution is undesirable. In particular, this extended wall solution would require a greater than desired height for the overall transformer which height would be made up mostly of wasted space, i.e. the space outward from the outermost winding. Since the metal laminates of the transformer core are commonly E-shaped, having a central tang in the core tube and legs extending axially of the bobbin body immediately outwardly of the walls, such a solution would provide a greater spacing between the legs and tang than is otherwise desired.

Various attempts have been made to overcome such problems, e.g., U.S. Pat. No. 3,909,761 (Miles-Platts Limited) discloses transformer bobbins moulded from plastic providing spool portions for primary and secondary windings of the transformer which are separated by a radially extending flange. A shroud is provided in the form of a casing which at least partially encloses the windings and has an internally formed ridge which engages the edge of the flange in an interleaving manner to minimize the "tracking" of current between the windings. In other words, the radially extending flange has a double lip formed on its periphery which encloses a groove, and this groove receives the internally formed ridge of the shroud therein, when the shroud and windings are assembled.

U.S. Pat. Nos. 4,405,913 and 4,510,478 (Mid-West Transformer Company) disclose a transformer coil body providing an elongated creepage path between primary and secondary windings in the form of at least one U-shaped channel member with a portion thereof projecting between the primary and secondary windings to provide a serpentine creepage path. In particular, a hollow core tube is provided with outwardly extending end walls and an intermediate separator wall. Additional walls are provided closely spaced to and parallel to one of the end walls and the intermediate separator wall, whereby a channel or space about the core is formed between the one end wall and its associated additional wall and the intermediate separator wall and its associated additional wall. A cap member is also provided, the cap member having an inturned leg for receipt between the separating wall and the associated additional wall. The cap member leg is three sided, being substantially U-shaped so that the leg is inserted in the gap between the separating wall and the associated additional wall around three sides of the core tube. The cap is also provided with a second inturned leg which fits in a corresponding manner in the gap between the end wall and its associated additional wall.

U.S. Pat. No. 4,716,394 (Cosmo Plastics Company) discloses a transformer bobbin assembly comprising a U-shaped shroud having a pair of bobbins removably mounted therein. The bobbins include detents to indicate proper positioning with respect to each other and cooperatively provide mounting channels for receipt of an intermediate rib of the shroud and spaced leg guides extending transversely inwardly from the shroud. In particular, the transformer bobbin assembly comprises a shroud and a pair of identical bobbins, the bobbins being sized to be received within the shroud with a sliding frictional fit. The shroud includes laterally spaced legs which are joined by a bight. The shroud has a longitudinal length corresponding with that of the assembled bobbins. Each of the legs are provided with a pair of transversely inwardly projecting leg guides. The shroud also includes a transversely inwardly projecting mounting rib, which extends around the entire inner periphery of the legs and the bight. The rib is located along a plane which axially bisects the shroud for receipt of the bobbins on each side thereof.

Each bobbin has a core which extends between a mating flange and an end flange, the core being of a rectangular cross-section, a coil winding area being defined about the core between the mating flange and the end flange. The mating flange has a mating face remote from the coil winding area. The mating face includes an interior planar surface portion which surrounds the core and which engages the interior surface portion of the other bobbin upon assembly within the shroud. The mating face includes a recessed planar surface portion extending around the periphery, which, upon assembly, cooperates with the corresponding surface on the other bobbin to define a mounting channel receiving the shroud rib.

British Patent No. 1 529 136 (Pye (Electronic Products) Limited) discloses a bobbin, moulded from an electrically insulating plastic material, which has a central core portion and a pair of end flanges, the space between the inner faces of the end flanges defining a winding space for a coil. One of the end flanges is substantially rectangular and has first and second integral members extending from opposite sides thereof at right angles to the plane of the outer face of the one end flange. A third integral member joins the sides of the first and second members remote from the end flange. The one end flange and the first, second and third members defining a rectangular prismatic space adapted to receive a second bobbin inserted in a direction parallel to the one end flange. In a preferred embodiment, the second bobbin which comprises a core and a pair of end flanges, has a member extending transversely from one edge of one of the end flanges so as to provide an increased creepage between the coils.

U S. Pat. No. 3,843,946 (Original Equipment Motors, Inc.) discloses a bobbin for a motor coil constructed with a flange having a lead wire retainer extended therefrom. The retainer is in the form of a tab having spaced fingers which present pockets for capturing the lead wires. The bobbin is received within a casing or housing provided with a slot for receiving the retainer tab.

As may be readily ascertained from the above, the prior art generally utilizes a middle or inside flange which is provided with a slot, the slot receiving a rib, formed on the shroud, therein. This approach requires a greater than normal wall thickness, thus, decreasing the available winding area on a finite-sized core; and this approach requires more complex dies for molding, creating an increased tooling cost. Accordingly, a need exists for an improved construction of a transformer bobbin.

SUMMARY OF THE INVENTION

It is an object of the present invention to provide a transformer bobbin assembly which minimizes the middle (inside) flange thickness.

It is a further object of the present invention to provide a transformer bobbin assembly having increased available winding room.

It is a still further object of the present invention to provide a transformer bobbin assembly which meets minimum creepage and clearance distance requirements, from the primary winding to the secondary winding, for various countries.

These and other objects of the invention, as will become apparent hereinafter, have been met by the provision of a transformer bobbin assembly comprising:

(A) a body member comprising a hollow core portion having an axis, a first end and a second end spaced apart axially from one another; a first radially extending flange formed at said first end of said core; a second radially extending flange formed at said second end of said core; an intermediate radially extending flange formed axially intermediate said first and second flanges, said intermediate flange having a first face portion facing said first flange and a second face portion facing said second flange, said first face portion and said first flange defining a primary winding area for winding a primary coil about said hollow core portion; a key block of a predetermined thickness formed on said second face portion of said intermediate flange;

(B) shroud means, mounted transverse to said axis, for enclosing at least a portion of the periphery of said primary winding area, said shroud means including a wall member slidingly engaging at least a portion of said second face portion of said intermediate flange, said wall member having a thickness equal to said thickness of said key block, said wall member and said key block cooperating to completely cover said second face of said intermediate flange, said wall member, said key block and said second flange defining a secondary winding area for winding a secondary coil about said hollow core portion.

In a preferred embodiment of the invention, the present invention provides a transformer bobbin assembly comprising:

(A) a bobbin body comprising:

(1) a hollow core having an axis, first and second ends spaced apart along said axis and an outer surface, said hollow core having a substantially rectangular cross-section of predetermined height and width perpendicular to said axis, (2) a first end wall, proximate said first end, projecting radially outwardly from said core around all four sides of said core substantially equidistantly a first distance from said outer surface, (3) a second end wall, proximate said second end, projecting radially outwardly from said core around all four sides of said core substantially equidistantly said first distance from said outer surface, (4) an intermediate wall, intermediate said first and second end walls, projecting radially outwardly from said core around all four sides of said core substantially equidistantly said first distance from said outer surface, said intermediate wall having a first face facing said first end wall and a second face facing said second end wall, (5) a key block member, disposed on said second face of said intermediate wall, said key block member coextensive with a widthwise side of said hollow core and extending outwardly coextensively with said intermediate wall, said key block member having a predetermined depth; and (B) a shroud comprising a substantially U-shaped member comprising two substantially parallel leg portions conjoined by a base portion with axially spaced inturned wall portions of said base portion and said leg portions, said leg portions having a length substantially equal to the height of said first end wall, said legs spaced apart by a distance substantially equal to the width of said first end wall, said inturned wall portions being axially spaced apart so as to slidingly contactingly receive therebetween said first end wall and said intermediate wall, said inturned wall portions of said base portion and said leg portions extending inwardly a distance equal to said first distance, said inturned wall portions having a depth equal to said predetermined depth of said key block member.

BRIEF DESCRIPTION OF THE DRAWING FIGURES

Figure 13:
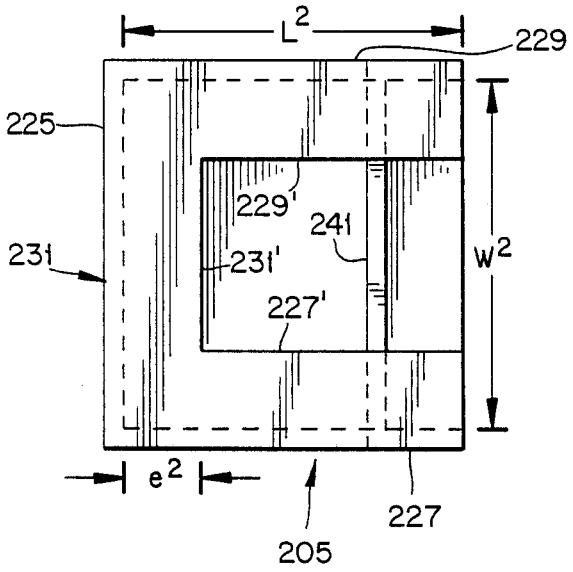

FIG. 13 side view of another shroud according to the present invention.

Figure 14:
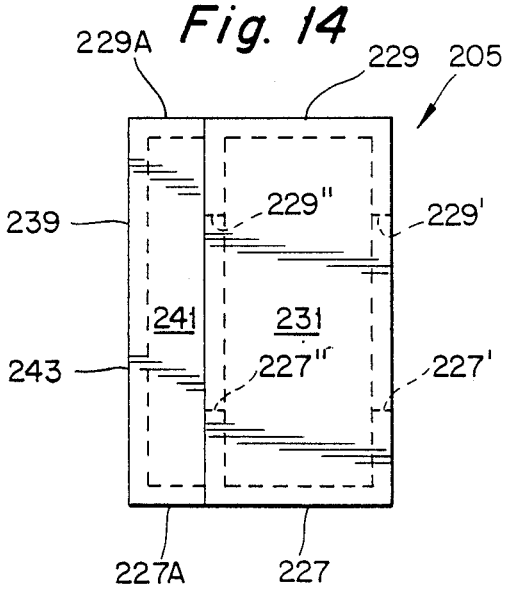

FIG. 14 is a top view of the shroud of FIG. 13.

Figure 15:
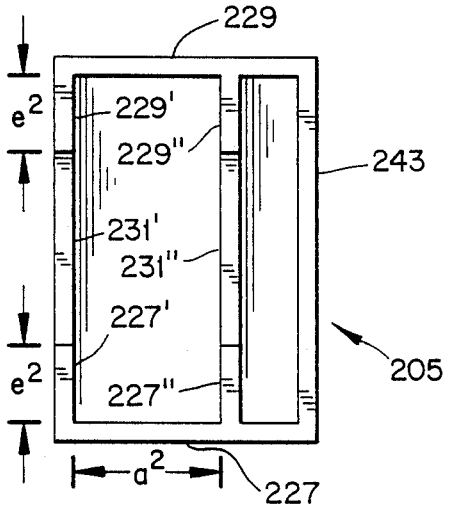

FIG. 15 is a bottom view of the shroud of FIG. 13.

Figure 16:
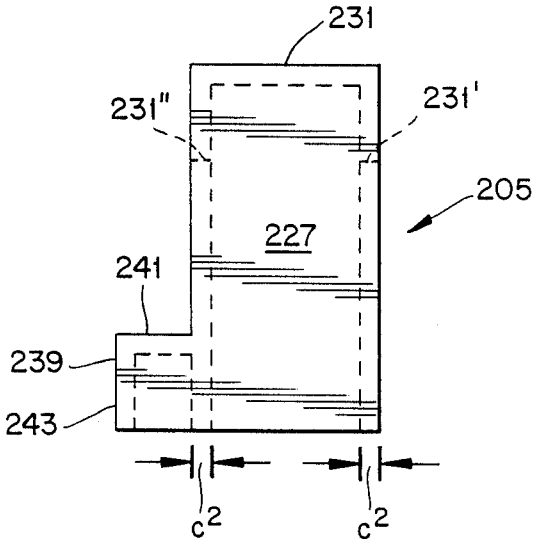

FIG. 16 is an end view of the shroud of FIG. 13.

Figure 17:
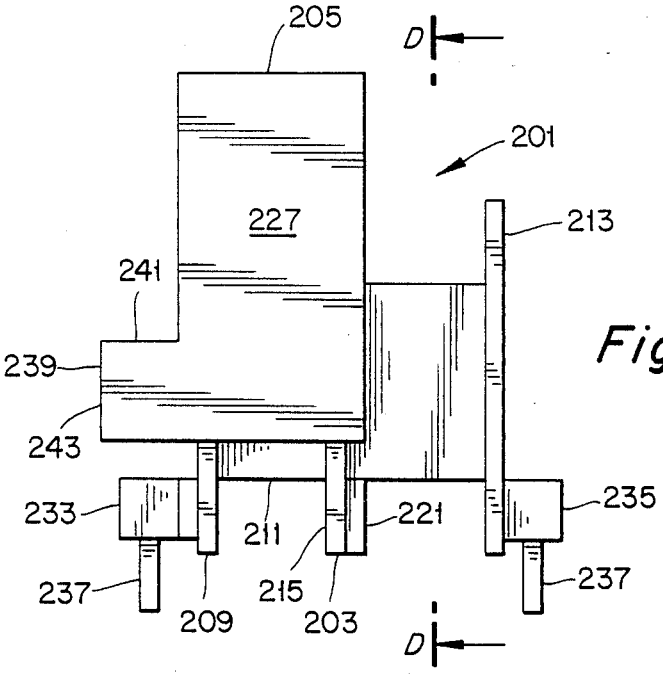

FIG. 17 is a side view of another partially assembled bobbin assembly according to the present invention.

Figure 18:
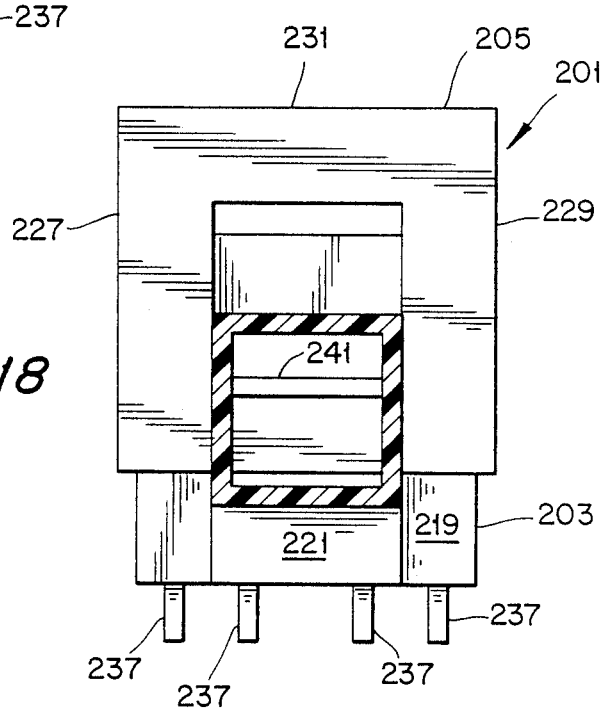

FIG. 18 is a sectional view of the partially assembled bobbin assembly of FIG. 17, along line D—D.

Figure 19:
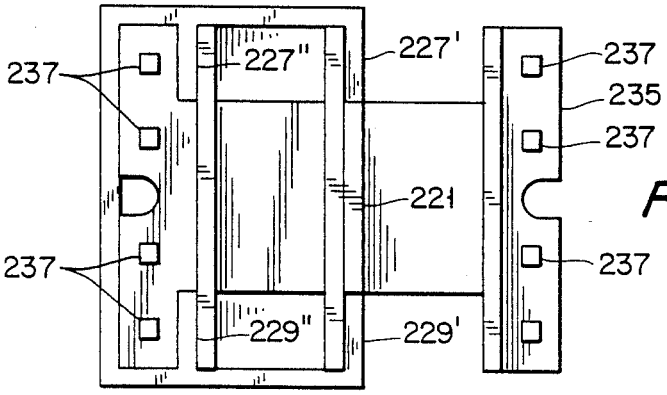

FIG. 19 is a bottom view of the partially assembled bobbin assembly of FIG. 17.

DETAILED DESCRIPTION OF THE INVENTION

FIGS. 1–9 illustrate a first embodiment of the present invention wherein a transformer bobbin assembly, generally indicated at 1, comprises a bobbin body 3 and a shroud 5.

Figure 1:
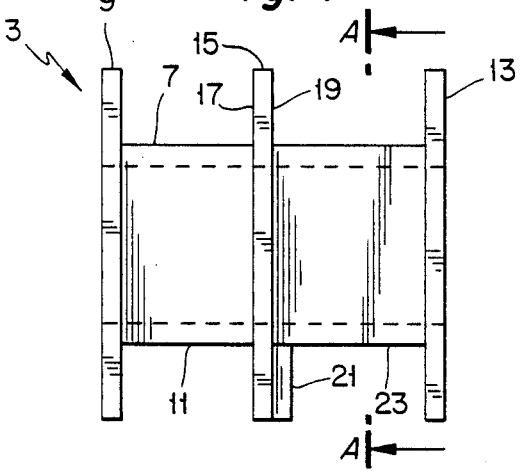
FIG. 1 is a side view of a bobbin according to the present invention.
Figure 2:
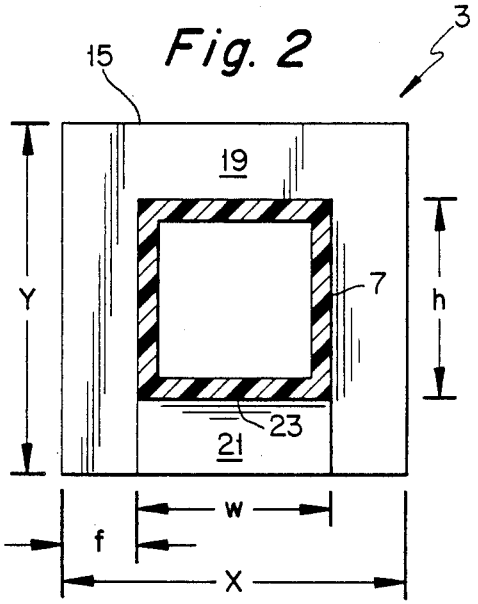
FIG. 2 is a sectional view of the bobbin of FIG. 1, along line A—A.
Figure 9:
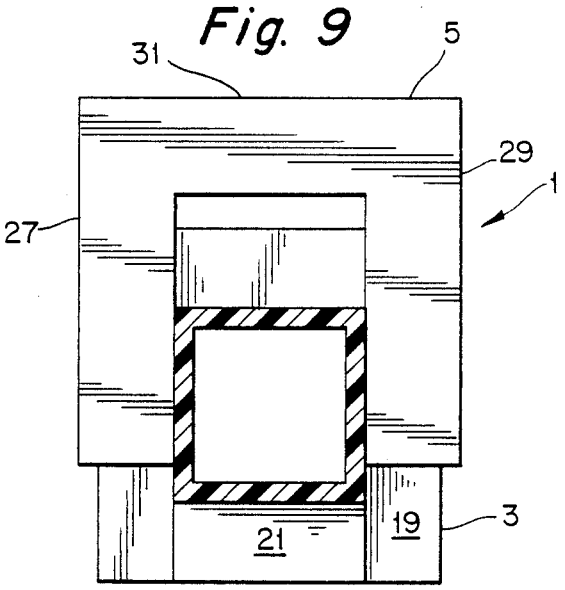
FIG. 9 is a sectional view of the partially assembled bobbin assembly of FIG. 8, along line B—B.
Figure 10:
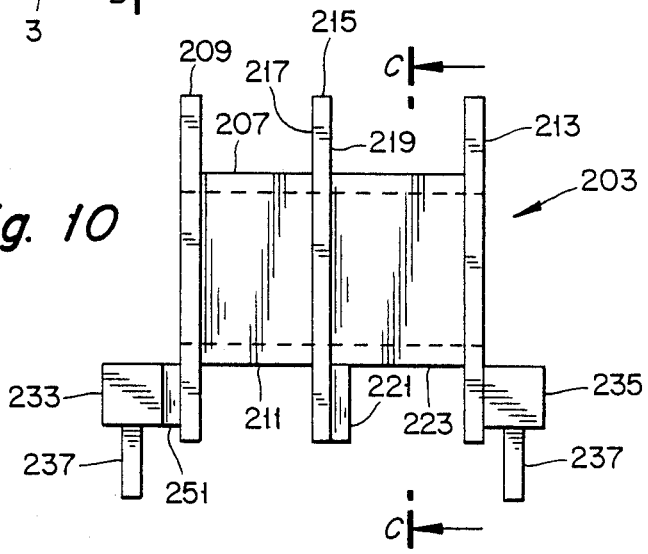
FIG. 10 is a side view of another bobbin according to the present invention.

The bobbin body 3 comprises a hollow core 7 having a substantially rectangular cross-section, as best seen in FIGS. 2 and 9, and having a predetermined height h and width w, as shown in FIG. 2.

A first end wall 9, proximate the first end of the hollow core 7, projects radially outwardly from the hollow core 7 around all four sides of the core substantially equidistantly from the outer surface 11 of the core.

A second end wall 13, proximate the second end of the hollow core 7, projects radially outwardly from the hollow core 7 around all four sides of the core substantially equidistantly from the outer surface 11 of the core.

An intermediate wall 15, intermediate the first end wall 9 and the second end wall 13, projects radially outwardly from the hollow core 7 around all four sides of the core substantially equidistantly from the outer surface 11 of the core. The intermediate wall 15 has a first face 17 facing the first end wall 9 and a second face 19 facing the second end wall 13.

Figure 3:
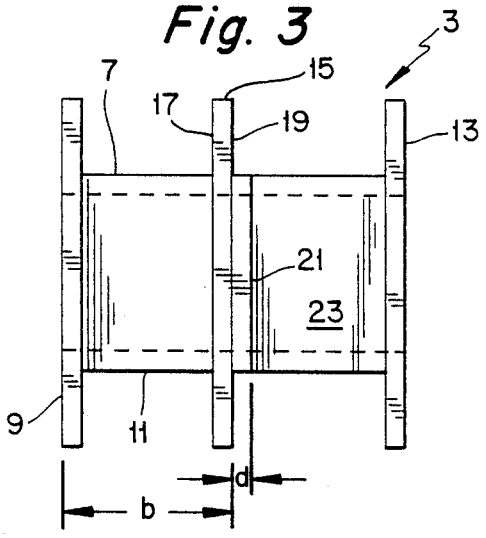
FIG. 3 is a bottom view of the bobbin of FIG. 1.

A key block member 21 is disposed on the second face 19 of intermediate wall 15. The key block member 21 extends coextensively with a widthwise side 23 of the hollow core 7 and extends outwardly coextensively with the intermediate wall 15. The key block member 21 has a predetermined depth d, as best seen in FIG. 3.

Figure 4:
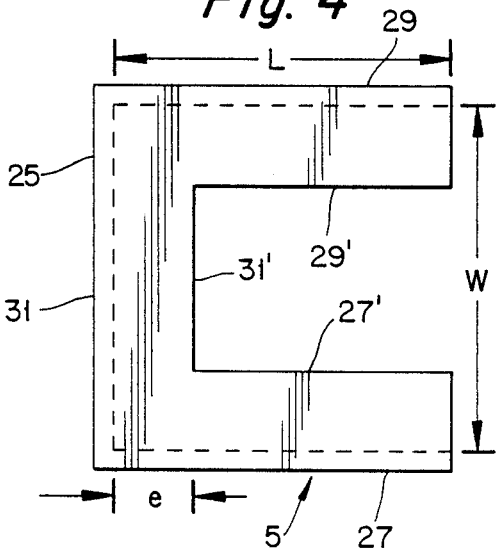
FIG. 4 is a side view of a shroud according to the present invention.
Figure 5:
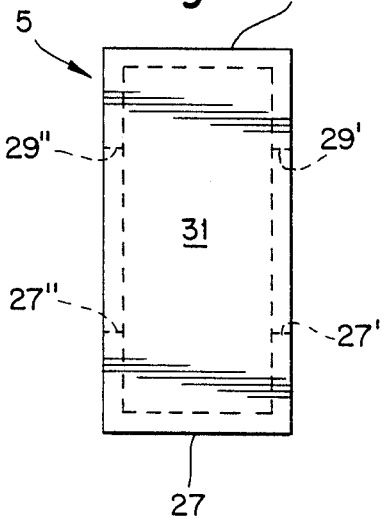
FIG. 5 is a top view of the shroud of FIG. 4.
Figure 6:
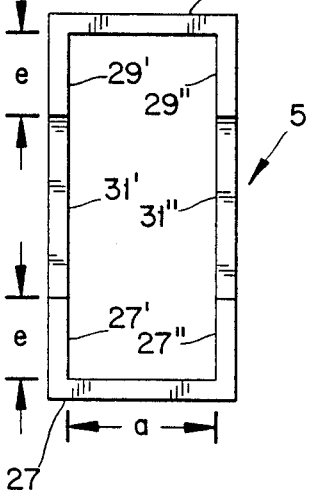
FIG. 6 is a bottom view of the shroud of FIG. 4.
Figure 7:
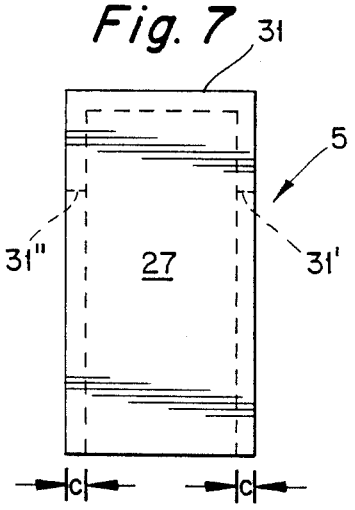
FIG. 7 is an end view of the shroud of FIG. 4.

The shroud 5 comprises a substantially U-shaped member 25 comprising two substantially parallel leg portions 27, 29 conjoined by a base portion 31, with axially spaced inturned wall portions 31′, 31″ of the base portion 31 and axially spaced inturned wall portions 27′, 27″ and 29′, 29″ of the leg portions 27 and 29, respectively. The leg portions 27, 29 have a length L, as shown in FIG. 4, substantially equal to the Y of the first end wall 9, as shown in FIG. 2; and the leg portions 27, 29 are spaced apart by a distance W, as shown in FIG. 4, substantially equal to the width X of the first end wall 9, as shown in FIG. 2. The inturned wall portions are axially spaced apart a distance a, as shown in FIG. 6, substantially equal to the distance b, shown in FIG. 3, so as to slidingly contactingly receive therebetween the first end wall 9 and the intermediate wall 15. The inturned wall portions extend inward a distance e, as shown in FIGS. 4 and 6, equal to the distance f, as shown in FIG. 2, by which walls 9 and 15 extend beyond the outer surface 11 of the core 7. The inturned wall portions 27′, 27″, 29′, 29″, 31′ and 31″ have a depth c, as shown in FIG. 7, which is substantially equal to the depth d of key block member 21, as shown in FIG. 3.

Figure 8:
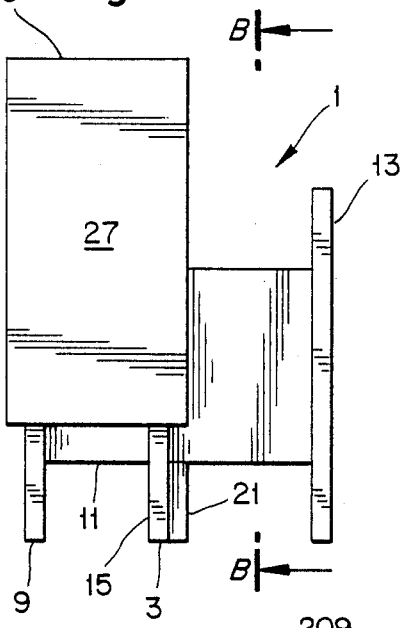
FIG. 8 is a side view of a partially assembled bobbin assembly according to the present invention.

As best seen in FIGS. 8 and 9, the shroud slides over the first end wall and the intermediate wall 15 to cover the first winding area defined between the first end wall and the intermediate wall; and then, when fully assembled, a second winding area is defined between the shroud 5, key block 21 and the second end wall 13.

FIGS. 10–19 illustrate a second embodiment of the present invention which is substantially identical to that previously described, but which is specifically adapted for use with a printed circuit board.

In general, there is illustrated a transformer bobbin assembly, generally indicated at 201 comprising a bobbin body 203 and a shroud 205.

Figure 11:
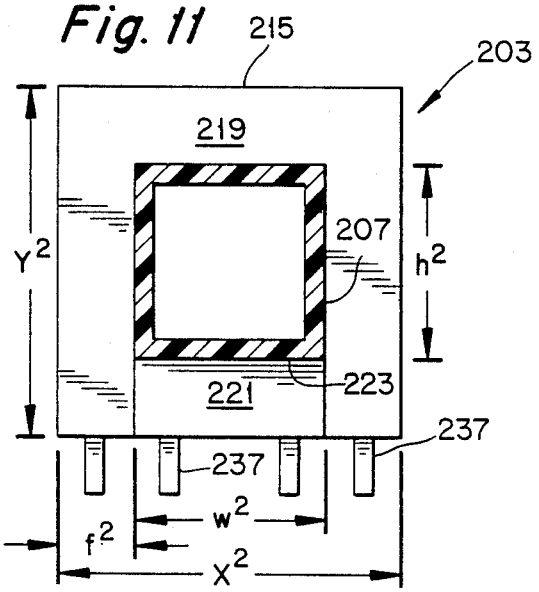
FIG. 11 is a sectional view of the bobbin of FIG. 10, along line C—C.

The bobbin body 203 comprises a hollow core 207 having a substantially rectangular cross-section, as best seen in FIGS. 11 and 18, and having a predetermined height $h^2$ and width $w^2$, as shown in FIG. 11.

A first end wall 209, proximate the first end of the hollow core 207, projects radially outwardly from the hollow core 207 around all four sides of the core substantially equidistantly from the outer surface 211 of the core.

A second end wall 213, proximate the second end of the hollow core 207, projects radially outwardly from the hollow core 207 around all four sides of the core substantially equidistantly from the outer surface 211 of the core.

An intermediate wall 215, intermediate the first end wall 209 and the second end wall 213, projects radially outwardly from the hollow core 207 around all four sides of the core substantially equidistantly from the outer surface 211 of the core. The intermediate wall 215 has a first face 217 facing the first end wall 209 and a second face 219 facing the second end wall 213.

Figure 12:
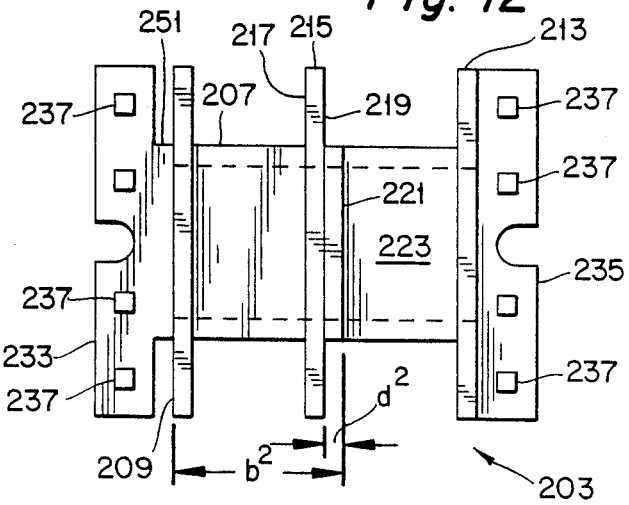
FIG. 12 is a bottom view of the bobbin of FIG. 10.

A key block member 221 is disposed on the second face 219 of intermediate wall 215. The key block member 221 extends coextensively with a widthwise side 223 of the hollow core 207 and extends outwardly coextensively with the intermediate wall 215. The key block member 221 has a predetermined depth $d^2$, as best seen in FIG. 12.

Terminal supports 233 and 235 are formed on the base of the first end wall 209 and the second end wall 213, respectively. These terminal supports are each fitted with a plurality of pin connectors 237 (four being shown in each case) for connection of the coils (not shown) wound on the bobbin body with a printed circuit. The coils (not shown) are connected to the pin connectors through passages (not shown) formed in the terminal supports. Terminal support 233 is connected to first end wall 209 by neck piece 251, which is of a width equal to that of hollow core 207 so as to allow inturned wall portions 227″ and 229″ to pass.

The shroud 205 comprises a substantially U-shaped member 225 comprising two substantially parallel leg portions 227, 229 conjoined by a base portion 231, with axially spaced inturned wall portions 231′, 231″ of the base portion 231 and axially spaced inturned wall portions 227′, 227″ and 229′, 229″ of the leg portions 227 and 229, respectively. The leg portions 227, 229 have a length $L^2$, as shown in FIG. 13, substantially equal to the height $Y^2$ of the first end wall 209, as shown in FIG. 11; and the leg portions 227, 229 are spaced apart by a distance $W^2$, as shown in FIG. 13, substantially equal to the width $X^2$ of the first end wall 209, as shown in FIG. 11. The inturned wall portions are axially spaced apart a distance $a^2$, as shown in FIG. 15, substantially equal to the distance $b^2$, shown in FIG. 12, so as to slidingly contactingly receive therebetween the first end wall 209 and the intermediate wall 215. The inturned wall portions extend inward a distance $e^2$, as shown in FIGS. 13 and 15, equal to the distance $f^2$, as shown in FIG. 11, by which walls 209 and 215 extend beyond the outer surface 211 of the core 207. The inturned wall portions 227', 227'', 229', 229'', 231' and 231'' have a depth $c^2$, as shown in FIG. 16, which is substantially equal to the depth $d^2$ of key block member 221, as shown in FIG. 12.

The shroud 205 is modified by the addition of a stepped portion 239 formed to receive therein the terminal support 233 on the first end wall 209. This stepped portion comprises a lateral extension 227A of leg portion 227, a lateral extension 229A of leg portion 229, a top horizontal wall 241 connecting lateral extensions 227A and 229A, and a side vertical wall 243 connecting lateral extensions 227A and 229A.

As best seen in FIGS. 17, 18 and 19, the shroud slides over the first end wall 209 and the intermediate wall 215 to cover the first winding area defined between the first end wall and the intermediate wall; and then, when fully assembled, a second winding area is defined between the shroud 205, key block 221 and the second end wall 213.

What is claimed is:

1. A transformer bobbin assembly comprising:

(A) a bobbin body comprising:

(1) a hollow core having an axis, first and second ends spaced apart along said axis and an outer surface, said hollow core having a substantially rectangular cross-section of predetermined height and width perpendicular to said axis, (2) a first end wall, proximate said first end, projecting radially outwardly from said core around all four sides of said core substantially equidistantly a first distance from said outer surface, (3) a second end wall, proximate said second end, projecting radially outwardly from said core around all four sides of said core substantially equidistantly said first distance from said outer surface, (4) an intermediate wall, intermediate said first and second end walls, projecting radially outwardly from said core around all four sides of said core substantially equidistantly said first distance from said outer surface, said intermediate wall having a first face facing said first end wall and a second face facing said second end wall, (5) a key block member, disposed on said second face of said intermediate wall, said key block member coextensive with a widthwise side of said hollow core and extending outwardly coextensively with said intermediate wall, said key block member having a predetermined depth; and (B) a shroud comprising a substantially U-shaped member comprising two substantially parallel leg portions conjoined by a base portion with axially spaced inturned wall portions of said base portion and said leg portions, said leg portions having a length substantially equal to the height of said first end wall, said legs spaced apart by a distance substantially equal to the width of said first end wall, said inturned wall portions being axially spaced apart so as to slidingly contactingly receive therebetween said first end wall and said intermediate wall, said inturned wall portions of said base portion and said leg portions extending inwardly a distance equal to said first distance, said inturned wall portions having a depth equal to said predetermined depth of said key block member.

2. The transformer bobbin assembly according to claim 1, wherein said first end wall further comprises a first set of electrical terminals and said second end wall further comprises a second set of electrical terminals.

* * * * *